United States Patent [19]

Reiling et al.

[11] Patent Number: 4,716,688

[45] Date of Patent: Jan. 5, 1988

[54] FIXTURE FOR HOLDING A HOLE-CUTTING TOOL HAVING CUTTING EDGES TO BE GROUND

[76] Inventors: Karl Reiling; Reinhold Reiling, both of Remchinger Strasse 4, D-7535 Königsbach-Stein, Fed. Rep. of Germany

[21] Appl. No.: 855,092

[22] Filed: Apr. 22, 1986

[30] Foreign Application Priority Data

May 11, 1985 [DE] Fed. Rep. of Germany ..... 3517034

[51] Int. Cl.[4] ..... B24B 3/26

[52] U.S. Cl. ..... 51/219 R; 51/218 A

[58] Field of Search ..... 51/219 R, 219 PC, 218 R, 51/217 R, 217 P, 217 A, 218 A, 218 P

[56] References Cited

U.S. PATENT DOCUMENTS

| | | | |
|---|---|---|---|
| 262,074 | 8/1882 | Maltby | 51/219 PC |
| 2,932,135 | 4/1960 | Tatar | 51/219 R |
| 4,270,315 | 6/1981 | Reiling et al. | 51/219 R |
| 4,547,999 | 10/1985 | Reiling et al. | 51/219 R |

FOREIGN PATENT DOCUMENTS

| | | | |
|---|---|---|---|
| 1111053 | 7/1961 | Fed. Rep. of Germany | 51/219 |

*Primary Examiner*—Robert P. Olszewski
*Assistant Examiner*—Robert Rose
*Attorney, Agent, or Firm*—Balogh, Osann, Kramer, Dvorak, Genova & Traub

[57] ABSTRACT

This invention relates to a fixture for holding a hole-cutting tool having cutting edges to be ground by means of a grinding wheel. The fixture comprising a stand carrying a pin and also comprises a gripping unit comprising two interconnected gripping jaws and detachably mounted on said pin in one predetermined position and adapted to be mounted thereon in at least one additional predetermined position, which jaws are adapted to grip said tool along an intermediate portion of its length. It is an object of the invention to provide such a tool-holding fixture which can be used in the crafts and in industry to grind relatively large twist drills or other hole-cutting tools which are 20, 40, 60 mm or even larger in diameter. This object is accomplished by the provision of an angle bracket, which comprises a vertical back structure and a horizontal base, wherein the pin for detachably mounting the jaw unit is carried by and rises vertically from the base and the vertical back structure is pivoted to the stand on a horizontal pivotal axis, which extends across the longitudinal axis of a hole-cutting tool gripped by the gripping unit and adjacent to the cutting tip of such tool so that the tool is pivotally movable about the pivotal axis.

13 Claims, 5 Drawing Figures

FIXTURE FOR HOLDING A HOLE-CUTTING TOOL HAVING CUTTING EDGES TO BE GROUND

BACKGROUND OF THE INVENTION

1. Field of the Invention

This invention relates to a fixture for holding a hole-cutting tool having cutting edges to be ground by means of a grinding wheel, which fixture comprises a stand carrying a pin and also comprises a gripping unit comprising two interconnected gripping jaws and detachably mounted on said pin in one predetermined position and adapted to be mounted thereon in at least one additional predetermined position, which jaws are adapted to grip said tool along an intermediate portion of its length.

2. Description of the Prior Art

Such fixtures for holding hole-cutting tools consisting of twist drills are known, e.g., from U.S. Pat. No. 4,270,315 and from U.S. Pat. No. 4,547,999. In said known fixtures the drill is gripped by means of two prismatic gripping jaws, which are interconnected to form a gripping unit. That gripping unit is detachably pivoted on a horizontal pivot pin mounted on a stand and is adapted to be mounted on said pin in a plurality of predetermined positions. The stand is arranged adjacent to a grinding wheel. When the cutting edges of the drill are to be reground, the gripping unit must be urged by hand against the end face of the grinding wheel about the mounting pin. Said embodiments are mainly intended for use with hobbyists' drilling machines, which are adapted to be provided with a grinding wheel.

SUMMARY OF THE INVENTION

It is an object of the invention to provide a tool-holding fixture which can be used in the crafts and in industry to grind relatively large twist drills or other hole-cutting tools which are 20, 40, 60 mm or even larger in diameter. For that purpose, a fixture is required which has a higher stability and can take up larger forces and can hold the tool with higher precision.

In fixtures of the kind described first hereinbefore that object is accomplished by the provision of an angle bracket, which comprises a vertical back structure and a horizontal base, wherein the pin for detachably mounting the jaw unit is carried by and rises vertically from the back and the vertical back structure is pivoted to the stand on a horizontal pivotal axis, which extends across the longitudinal axis of a holecutting tool gripped by said gripping unit and adjacent to the cutting tip of such tool so that said tool is pivotally movable about said pivotal axis.

The back structure comprises a tapered block having a generally vertical, horizontally tapered surface facing said mounting pin and in snug contact with said gripping unit. Said base is connected to the underside of said tapered block by fixing screws, which define a hinge line which extends transversely to the mounting pin. A pressure-applying screw is screwed into said base at a point which is transversely spaced from said hinge axis and said pressure-applying screw bears on the underside of said tapered block and is operable to force said tapered block away from said base by a small amount about said hinge axis.

DETAILED DESCRIPTION OF THE PREFERRED EMBODIMENT

Figure 1:
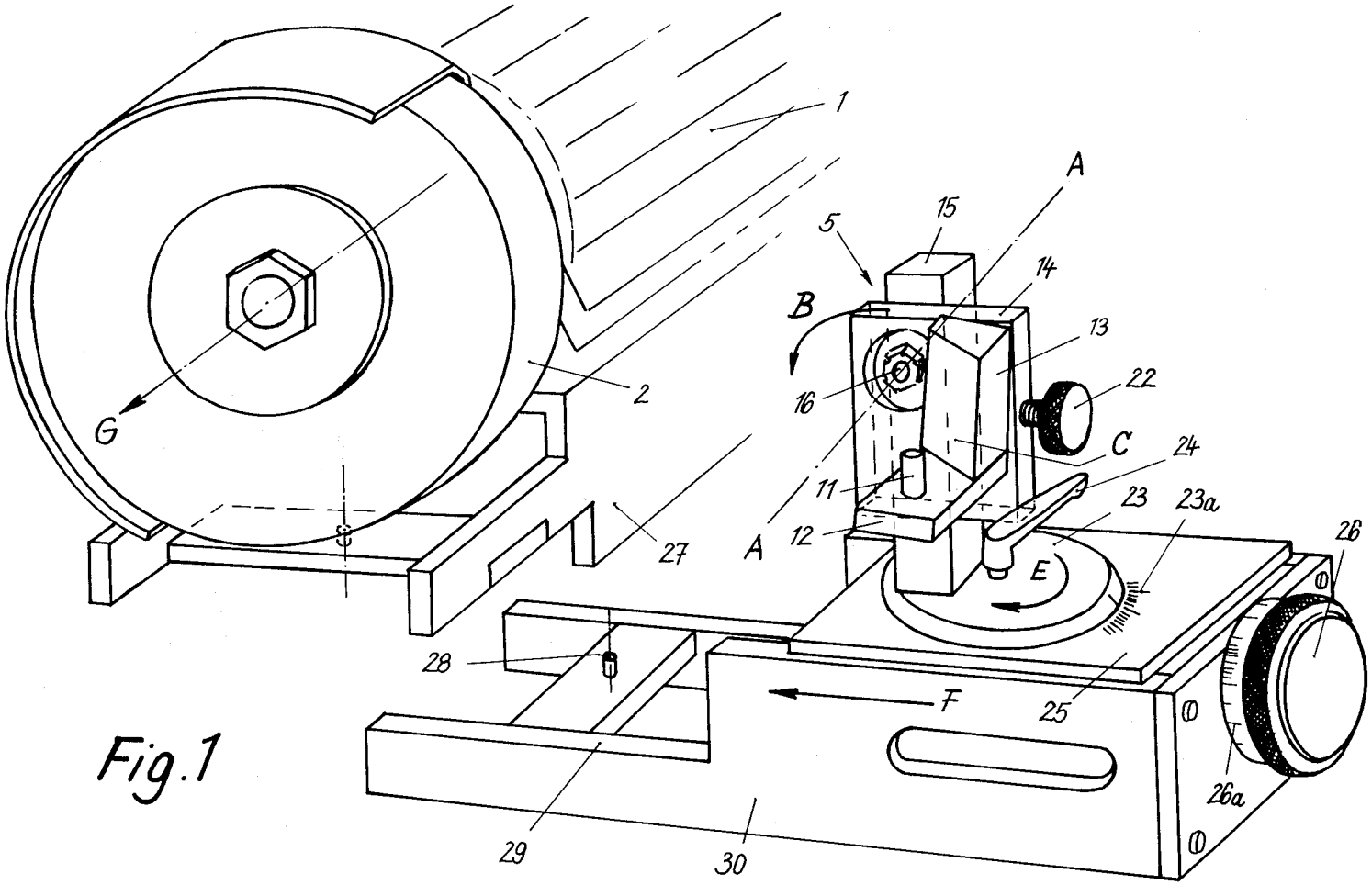
FIGS. 1 and 2 are perspective views showing a fixture for holding a twist drill having cutting edges to be ground. The fixture is shown in FIG. 1 without a gripping unit and in FIG. 2 with a gripping unit and with a twist drill gripped by said gripped unit.

An illustrative embodiment of the invention will now be described in more detail with reference to the drawing.

In the embodiment shown on the drawing, the fixture is used to hold a hole-cutting tool consisting of a twist drill which is to be ground at its cutting edges by means of a grinding wheel 2 mounted on a grinding wheel drive 1. The twist drill 3 is gripped by means of a gripping unit 4, which is of the kind disclosed in U.S. Pat. No. 4,270,315 and U.S. Pat No. 4,547,999 and is adapted to be detachably fitted in two predetermined positions on an angle bracket 5. The present gripping unit 4 comprises two prismatic gripping jaws 6 and 7, which are formed on their confronting inside surfaces with angle-section grooves *6a*, *7a*, respectively and are embraced by a U-shaped retaining member 8. One prismatic jaw 6 is fixed to the U-shaped retaining member 8 by a screw *8a* and the other prismatic jaw 7 is guided in a groove *8b* of the U-shaped retaining member 8 and is engaged by a clamp screw 9 for forcing the prismatic jaw 7 against a twist drill 3 extending in the grooves *6a*, *7a*. The prismatic jaws 6 and 7 are formed with respective mounting holes 10 to be fitted in alternation on the mounting pin 11 to permit the drill 3 to be ground on one side and the other.

The gripping unit 4 is adapted to be fitted on mounting pin 11 of the bracket 5. The base 12 of the bracket 5 carries the upstanding pin 11. The rear structure of the bracket consists of two parts, namely, a tapered block 13 and a back plate 14. The back plate 14 is pivoted to an upright stand 15 by means of a horizontal pivot pin 16, which is at right angles to the mounting pin 11. When the twist drill 3 is properly gripped by the jaws 6, 7 so that the cutting tip *3a* protrudes from the jaws 6, 7, the pivotal axis A—A defined by the pivot pin 16 crosses the longitudinal axis of the drill 3 adjacent to its cutting tip *3a* and preferably intersects said longitudinal axis so that the cutting tip *3a* is pivotally movable as is indicated by the arrow B.

The tapered block 13 has a generally vertical, horizontally tapered surface C, which faces the mounting pin 11 and is horizontally tapered toward the pivot pin 16 and in snug contact with the gripping unit 4 which is fitted on the mounting pin 11.

The base 12 is connected to the tapered block 13 and extends at right angles thereto. The tapered block 13 is pivoted to the back plate 14 for a limited pivotal movement about the pivot *16a*, which is offset from the axis A—A. The tapered block 13 has a slightly tapered, generally vertical surface C so that the gripping unit 4 which has been fitted on the pin 11 will bear on the surface C and will thus be fixed in position. The base 12 is connected to the underside of the tapered block 13 by two fixing screws 17, which are spaced apart to define a hinge axis which is transverse to the mounting pin 11. A pressure-applying screw 17*a* is screwed in the base 12 and at a point which is spaced from said hinge axis bears on the underside of the tapered block 13 and is operable to face the tapered block 13 away from the base 12 about said hinge axis. The contact pressure between the gripping unit and the tapered block 13 can be adjusted by means of the pressure-applying screw.

The pivotal movement (arrow D) of the tapered block 13 about the pivot pin 16*a* is limited by a pin 18, which is screwed into the tapered block 13 below the pivot pin 16*a* and has a head which extends into a guide slot 19 in the back plate 14. The pin 18 is provided under its head with a cap ring 20, which is engaged in the guide slot 19 on one side by a return spring 21 and on the other side by an adjusting screw 22.

Figure 2:
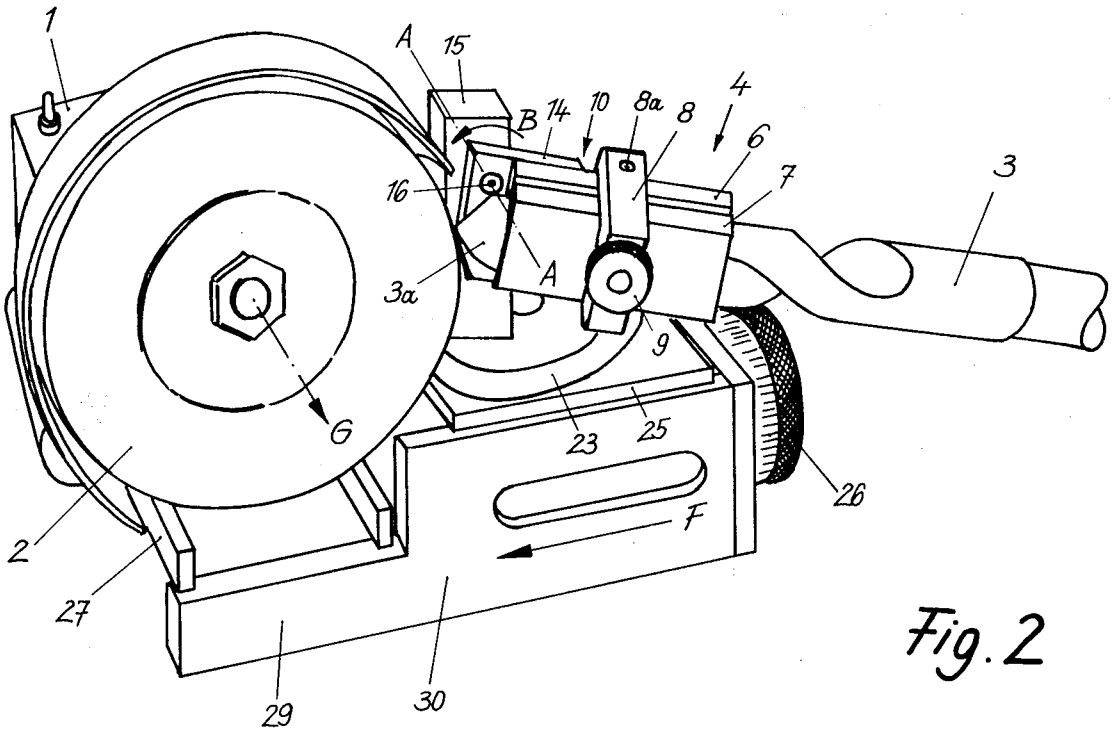
Figure 4:
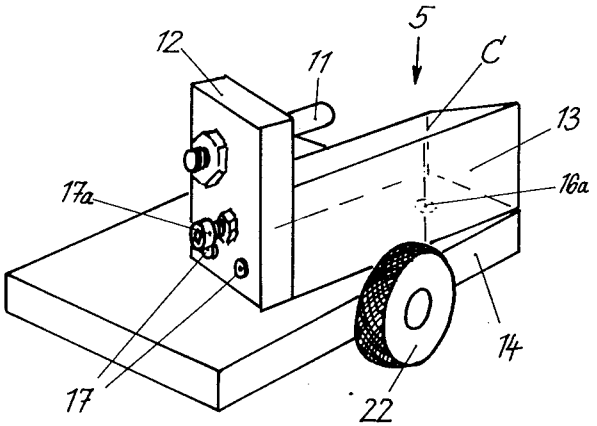
FIG. 4 is a perspective view showing the angle bracket.
Figure 3:
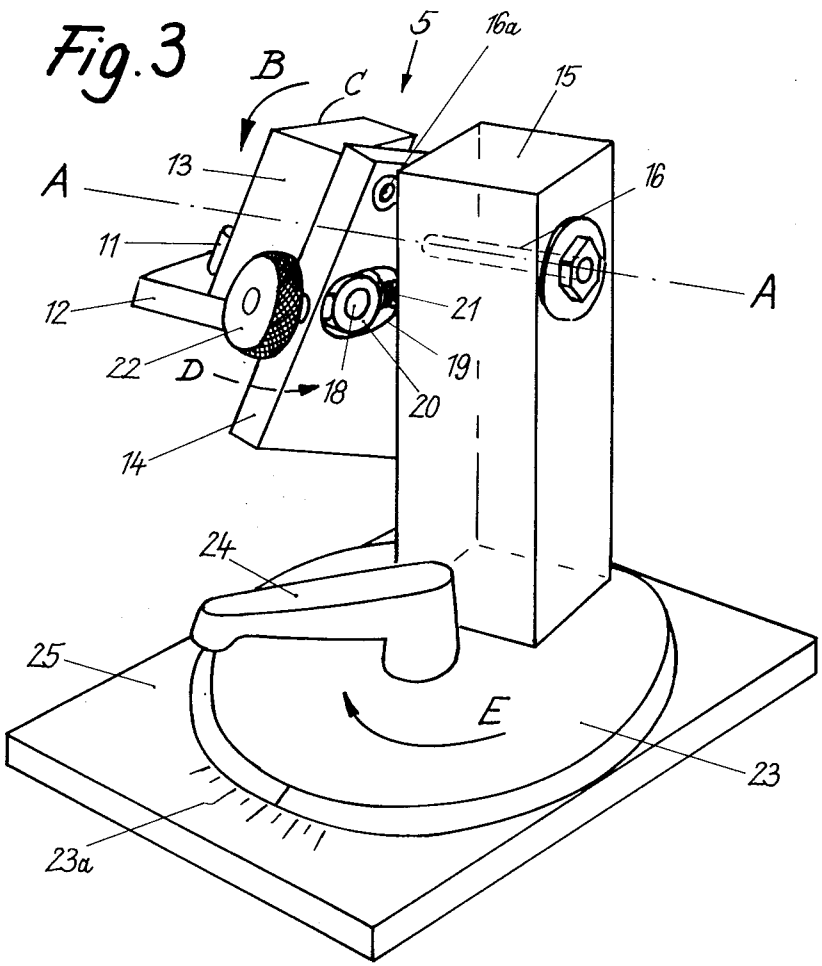
FIG. 3 is a perspective fragmentary view showing a stand and an angle bracket viewed in an upwardly inclined direction.
Figure 5:
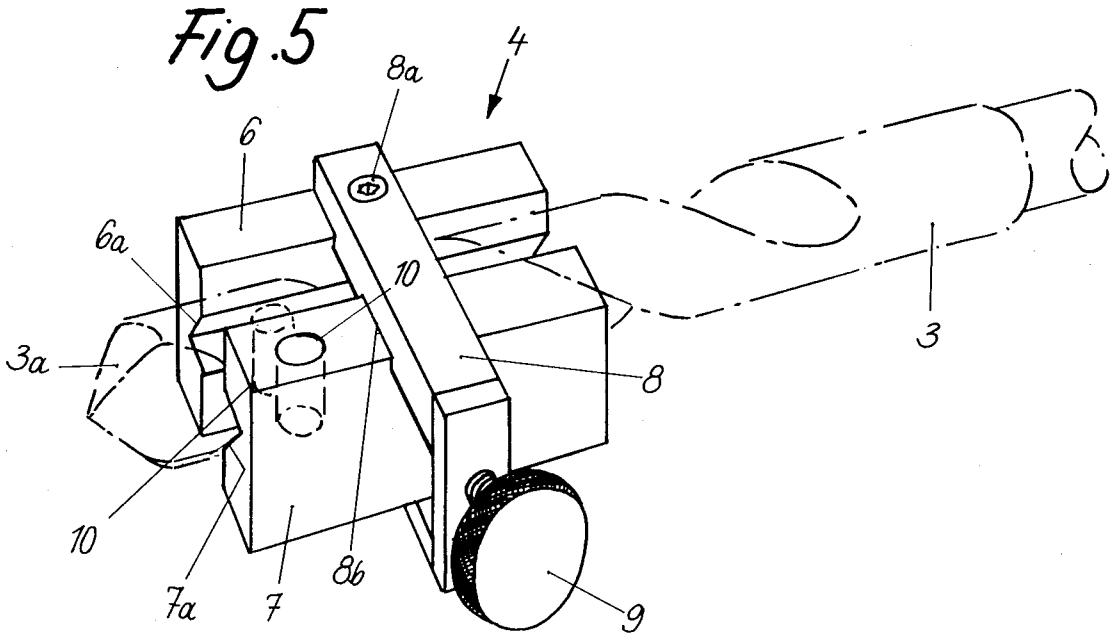
FIG. 5 is a perspective view showing the gripping unit and the twist drill gripped by said unit.

The stand 15 is mounted on a turntable 23, which is mounted on a carriage 25 for rotation in the direction of the arrow E. The turntable 23 is provided with a locking lever 24, which is operable to hold the turntable against rotation. The carriage 25 is movable along a track on a base 30 at right angles to the axis of the grinding wheel 2 and of the grinding wheel drive 1 in the direction indicated by the arrow F so that the drill 3 gripped by the gripping unit can be moved into and out of engagement with the end face of the grinding wheel 1. The grinding wheel drive 1 is axially displaceable in the direction indicated by the arrow G for a further adjustment, as is apparent from the drawing. Respective scales 23*a* and 25*a* are associated wit the turntable 23 and with the screw 26 for adjusting the carriage 25 along its track. The grinding wheel drive 1 is mounted on a base 27, which has a hole fitted on a pin 28 provided on a recessed portion 29 of the base 30 for the carriage 28, as is apparent from FIGS. 1 and 2.

We claim:

1. In a fixture for holding an elongate hole-cutting tool having a longitudinal axis and a cutting tip formed with at least two cutting edges to be ground by a grinding wheel, which fixture comprises:

a stand;

a mounting pin carried by said stand, and a gripping unit detachably mounted on said mounting pin in one predetermined position for grinding one of said cutting edges and adapted to be detachably mounted on said mounting pin in another predetermined position for grinding another of said cutting edges, said gripping unit comprising two gripping jaws for gripping said tool so that said cutting tip protrudes from said jaws, the improvement residing in that said fixture comprises an angle bracket having a base and a vertical back structure rising from said base, said mounting pin is carried by and rises from said base, said back structure is pivoted to said stand on a horizontal pivotal axis which is disposed above said base and extends at right angles to said mounting pin, and said gripping jaws are adapted to grip said tool so that said cutting tip protrudes from said jaws adjacent to said pivotal axis and said longitudinal axis crosses said pivotal axis, wherein said gripping jaws are adapted to grip said tool so that said cutting tip protrudes from said jaws adjacent to said pivotal axis and said longitudinal axis is oblique to said pivotal axis, and wherein said back structure comprises a generally vertical tapered surface which faces said mounting pin and is in snug contact with said gripping unit and is horizontally tapered toward said pivotal axis.

2. The improvement set forth in claim 1, wherein said back structure comprises a tapered block which is formed with said tapered surface and connected to and extends substantially at right angles to said base, and a back plate, which is pivoted to said stand on said pivotal axis, and stop means are provided for limiting the pivotal movement of said tapered block about said second horizontal axis.

3. The improvement set forth in claim 2, wherein said base is fixed to the underside of said tapered block by two spaced apart screws, which define a hinge axis which is transverse to said mounting pin, and a pressure-applying screw is screwed in said base and bears on the underside of said tapered block at a point which is spaced from said hinge axis so that said pressure-applying screw is operable to force the underside of said tapered block away from said base and thus to control the contact pressure between said tapered surface and said gripping unit.

4. The improvement set forth in claim 2, wherein said top means comprise a slot formed in one of the parts consisting of said back plate and said tapered block and a stop pin carried by the other of said parts and extending in said slot.

5. The improvement set forth in claim 4, wherein said stop means comprise an adjustable stop member, which is engageable by said stop pin to limit the pivotal movement of said tapered block about said second horizontal axis in one sense.

6. The improvement set forth in claim 5, wherein spring means are provided whih act on said stop pin and urge it against said stop member.

7. The improvement set forth in claim 5, wherein said stop pin is screwed in said tapered block and said slot is formed in said back plate.

8. The improvement set forth in claim 7, wherein said stop pin comprises a head extending into said slot, said adjustable stop member comprises an adjusting screw, which is screwed in said back plate and engages said head on one side, and spring means are provided, which engage said head on the other side and urge said head against said adjusting screw.

9. The improvement set forth in claim 7, wherein said head comprises a cap engaged by said spring means and said adjusting screw.

10. The improvement set forth in claim 1, wherein a carriage base is provided, which comprises a horizontal track, a carriage is carried by said carriage base and movable along said track, a turntable is mounted on said carriage for rotation about a vertical axis, and said stand is mounted on and rised from said turntable.

11. The improvement set forth in claim 10, wherein said stand is eccentrically mounted on said turntable.

12. The improvement set forth in claim 10, wherein indicating means comprising a scale are provided for indicating the position of said turntable relative to said carriage.

13. The improvement set forth in claim 12, wherein screw means are mounted in said base and rotatable to move said carriage along said track and indicating means comprising a scale are provided for indicating the position of said screw means relative to said carriage base.

* * * * *